US010339902B2

(12) United States Patent
Creek

(10) Patent No.: US 10,339,902 B2
(45) Date of Patent: Jul. 2, 2019

(54) STRING SUPPORT FOR STRINGED MUSICAL INSTRUMENT

(71) Applicant: Kathryn L. Creek, Los Alamos, NM (US)

(72) Inventor: Kathryn L. Creek, Los Alamos, NM (US)

( * ) Notice: Subject to any disclaimer, the term of this patent is extended or adjusted under 35 U.S.C. 154(b) by 346 days.

(21) Appl. No.: 15/410,326

(22) Filed: Jan. 19, 2017

(65) Prior Publication Data

US 2017/0206867 A1 Jul. 20, 2017

Related U.S. Application Data

(60) Provisional application No. 62/281,172, filed on Jan. 20, 2016.

(51) Int. Cl.
*G10D 3/04* (2006.01)
*G10D 1/08* (2006.01)

(52) U.S. Cl.
CPC ..... *G10D 3/04* (2013.01); *G10D 1/085* (2013.01)

(58) Field of Classification Search
CPC ..... G10D 3/04; G10D 1/085
USPC ..... 84/307, 299
See application file for complete search history.

(56) References Cited

U.S. PATENT DOCUMENTS

| | | | | |
|---|---|---|---|---|
| 934,678 | A * | 9/1909 | Laurian | G10D 3/04 84/298 |
| 5,078,041 | A | 1/1992 | Schmued | |
| 5,410,936 | A | 5/1995 | Ellsworth et al. | |
| 5,481,956 | A * | 1/1996 | LoJacono | G10D 3/04 84/314 N |
| 5,750,910 | A * | 5/1998 | LoJacono | G10D 3/04 84/314 N |
| 6,031,165 | A * | 2/2000 | Brekke | G10D 3/04 84/298 |
| 6,875,910 | B2 | 4/2005 | Naimish | |
| 7,326,839 | B2 | 2/2008 | Kinoshita | |
| 7,838,752 | B2 | 11/2010 | LaMarra | |
| 8,921,675 | B2 | 12/2014 | Gimpel et al. | |
| 2005/0150348 | A1 | 7/2005 | Ito | |
| 2011/0252941 | A1 | 10/2011 | Prins | |
| 2012/0103171 | A1 | 5/2012 | Lashbrook | |
| 2013/0152762 | A1 | 6/2013 | Gimpel et al. | |

* cited by examiner

*Primary Examiner* — Jianchun Qin
(74) *Attorney, Agent, or Firm* — Thomas E. Lees, LLC

(57) ABSTRACT

A string support for a musical instrument comprises a string support body and a plate set. The string support body has a length, a height, a top surface, and a cavity that recesses into the top surface of the string support body. The cavity extends in a primary direction and has a width and a depth. The plate set comprises at least one string-engaging plate (e.g., one per string) and at least one spacer plate per string-engaging plate that seat within the cavity, stacked in a direction of the width of the cavity. Moreover, each string-engaging plate can have a string-engaging edge (or passthrough) at a height greater than a height of each spacer plate. The order of the spacer plate(s) and associated string-engaging plate is adjustable to position the string-engaging plate forward or backward in the direction of the cavity width.

20 Claims, 7 Drawing Sheets

STRING SUPPORT FOR STRINGED MUSICAL INSTRUMENT

CROSS REFERENCE TO RELATED APPLICATIONS

This application claims the benefit of U.S. Provisional Patent Application Ser. No. 62/281,172, filed Jan. 20, 2016, entitled BRIDGE FOR STRINGED MUSICAL INSTRUMENT, the disclosure of which is hereby incorporated herein by reference.

BACKGROUND

Various aspects of the present disclosure relate generally to a string support for a stringed musical instrument that can be configured to function as a bridge or a nut, and in particular to a string support that facilitates setting up the playability of a stringed musical instrument by providing adjustments for string height, string spacing, intonation (length), or a combination thereof.

A bridge is a device that interfaces between strings and a body of a stringed musical instrument, typically towards a lower bout of the body. More particularly, the bridge supports and spaces the strings from the body of the musical instrument. The bridge also contributes to setting the height of the strings above a fretboard of a neck (which extends from the body), thus contributing to the action of the instrument. Moreover, the bridge serves as an endpoint upon which the strings either terminate or cross over to transmit the vibration of those strings to the body.

A nut is typically a flat member extending across the width of the neck of the stringed musical instrument, often adjacent to a headstock, scroll or other feature that supports tuners. The nut supports and spaces the strings from the neck of the musical instrument, thus also contributing to the action of the instrument. In this regard, the nut and bridge together define the endpoints of each string of the stringed musical instrument.

BRIEF SUMMARY

According to aspects of the present disclosure, a string support for a stringed musical instrument comprises a string support body and at least one plate set. The string support body has a major length, a height, a top surface, and a cavity that recesses into the top surface of the string support body. The cavity extends in a primary direction. Moreover, the cavity has a width and a depth. The string support can be configured to function as a bridge or a nut, e.g., by selecting an appropriate form factor of the string support body. In some implementations, a first string support implements a bridge, and a second string support implements a nut on the same stringed musical instrument.

Each plate set comprises a string-engaging plate. Each plate set can also include zero or more spacer plates. In an example application, there is one plate set including one string-engaging plate per string of a corresponding stringed musical instrument to which the string support is attached. In an example configuration, each plate set comprises at least one spacer plate (typically two or more spacer plates per string-engaging plate). Plates in each plate set seat vertically within the cavity of the support body. Moreover, the plates are stacked in a direction along the width of the cavity (length of the string).

Each string-engaging plate including at least a portion thereof that is set to a height greater than a height of each associated spacer plate. In a first example embodiment, each string-engaging plate has a string-engaging edge set to a height greater than a height of each associated spacer plate. This edge can be notched or slotted to seat a string therein. In a second example embodiment, each string-engaging plate has a passthrough, e.g., a hole extending through the face of the string-engaging plate, through which a string is fed. Here, the passthrough is set to a height greater than a height of each associated spacer plate.

In use, the order of the plates of each plate set is adjusted to position each string-engaging plate forward or backward in the direction of the width of the cavity. This is useful to set the intonation of the corresponding stringed musical instrument.

According to further aspects of the present disclosure, a string support for a stringed musical instrument comprises a string support body and a plurality of plate sets. If the string support is to function as a bridge, each plate set defines a corresponding saddle. Likewise, if the string support is to function as a nut, then each plate set defines a nut slot. The string support body has a major length, a height, a top surface, and a cavity that recesses into the top surface of the string support body. The cavity extends in a primary direction. Moreover, the cavity has a width and a depth. The plurality of plate sets, includes at least a first plate set comprising a string-engaging plate and at least one spacer plate, a second plate set comprising a string-engaging plate and at least one spacer plate, a third plate set comprising a string-engaging plate and at least one spacer plate, and a fourth plate set comprising a string-engaging plate and at least one spacer plate.

Each plate set seats vertically within the cavity, stacked in the direction of the width of the cavity. Also, a face of at least one plate in each plate set is substantially parallel to the primary direction of the cavity. As with some other embodiments herein, the string-engaging plate of each plate set can have a string-engaging edge set to a height greater than a height of each corresponding spacer plate. As another example configuration, each string-engaging plate can have a passthrough, e.g., a hole extending through the face of the string-engaging plate, through which a string is fed. Here, the passthrough is set to a height greater than a height of each associated spacer plate. The order of the plates in each plate set is adjustable to independently position the string-engaging plate of each plate set forward or backward in the direction of the width of the cavity.

According to still further aspects of the present invention, a musical instrument has an instrument body, neck that extends from the instrument body, and a first string support arranged towards a lower bout of the instrument body defining a bridge. The first string support comprises a string support body and a plurality of saddles implemented as corresponding plate sets as described in the preceding paragraphs. When strings are installed on the musical instrument, e.g., a four string bass for example, a first string is supported by a string-engaging plate of the first plate set, a second string is supported by a string engaging plate of the second plate set, a third string is supported by a string-engaging plate of the third plate set, and a fourth string is supported by a string-engaging plate of the fourth plate set. In this regard, the order of the plates in each plate set is adjustable to independently position the string-engaging plate of each plate set forward or backward in the direction of the width of the cavity, and hence the length-wise direction of the associated string, thus providing an intonation adjustment.

In yet a further example implementation, a second string support can be implemented as a nut positioned at the end of the neck. The nut can include any of the features of a string support as set out more fully herein.

In still another configuration, a musical instrument has an instrument body, neck that extends from the instrument body, and a first string support implemented as a nut positioned at the end of the neck. The nut can include any of the features of a string support as set out more fully herein. Here, the bridge can be a conventional bridge, or the bridge can also comprise a string support as described more fully herein.

According to yet further aspects of the present disclosure, a method of adjusting a setup of a stringed musical instrument comprises exposing a string support on a musical instrument having an instrument body and neck that extends from the instrument body, the string support comprising a string support body having a major length, a height, a top surface, and a cavity that recesses into the top surface of the string support body, the cavity extending in a primary direction and having a width and a depth. The method also comprises arranging a plurality of plates into at least one plate set, e.g., one plate set for each string of the musical instrument, wherein each plate set comprises a string-engaging plate and at least one spacer plate. Moreover, the method comprises stacking the plates of each plate set so that the string-engaging plate is in a desired order relative to at least one spacer plate, and setting the plates in the cavity such that each of the plate sets seats vertically within the cavity, stacked in the direction of the width of the cavity such that a face of at least one plate in each plate set is substantially parallel to the primary direction of the cavity. Here, the string-engaging plate of each plate set can have a string-engaging edge set to a height greater than a height of each corresponding spacer plate, a passthrough set to a height greater than a height of each corresponding spacer plate, or other feature to support a corresponding string, examples of which are described more fully herein.

DETAILED DESCRIPTION

As will be described in greater detail with regard to the FIGURES herein, a string support is provided, which is suitable for use with a stringed musical instrument. The string support includes a string support body having a cavity that receives at least one plate set. Each plate set provides flexibility in setting string height, string spacing, string intonation, or a combination thereof. In this manner, the string support provides an extremely wide range of adjustability and customization when setting up the playability of a corresponding stringed musical instrument. A string support can function as a bridge. Also, a string support can function as a nut. Additional benefits may apply to a stringed musical instrument where a first string support functions as a bridge, and a second string support functions as a nut. In this regard, a string support can adapt to virtually any design of stringed musical instruments.

Each plate in a plate set functions as either a spacer plate or a string-engaging plate. By controlling the number of plates in a set, the level of granularity/precision of intonation can be controlled. Moreover, by setting the height of the string-engaging plate, the height of each string of a stringed musical instrument can be setup and/or adjusted. Yet further, by controlling the number of plate sets that are aligned in the cavity of the string support body, the string support can be adapted to any number of strings. Still further, by controlling where a string contacts a corresponding string-engaging plate, the relative string spacing of the strings of the musical instrument can be adjusted.

As noted above, in certain implementations, a stringed musical instrument includes a first string support implementing a bridge, and a second string support implementing a nut. This provides the ability to control a setup by making adjustments to string height, string spacing, etc., independently for each string, and from both endpoints of a corresponding string. For instance, by controlling the position of a string-engaging plate of the nut and a string-engaging plate of the bridge for the same string, more precise intonation can be set compared to conventional systems.

Figure 1:
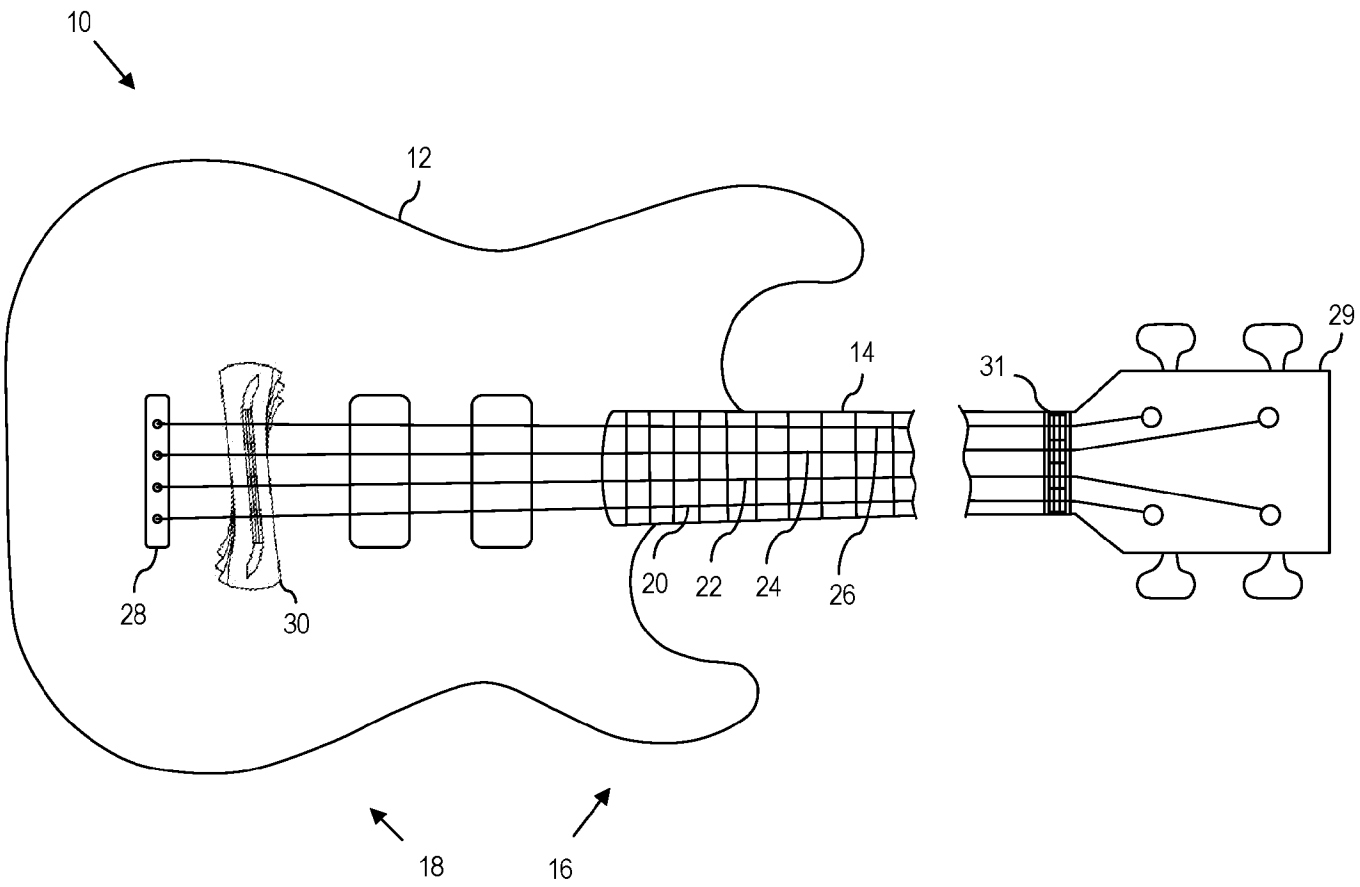
FIG. 1 is a top view of a stringed musical instrument, according to aspects of the present disclosure.

Referring now to the drawings, and in particular, to FIG. 1, a top view of a portion of a stringed musical instrument 10 is illustrated according to aspects of the present disclosure. The musical instrument 10 is illustrated as a four string bass guitar. However, in practice, the stringed musical instrument 10 may be a bass guitar, guitar, mandolin, or other stringed instrument with any number of strings. The musical instrument 10 includes in general, an instrument body 12 and a neck 14 extending from the instrument body 12. The instrument body 12 is conceptually divided into two general regions, including an upper bout 16 and a lower bout 18. The upper bout 16 is typically separated from the lower bout 18 by a waist or narrowed/tapered region of the instrument body 12. Moreover, the upper bout 16 is the portion of the instrument body 12 in the vicinity of where the neck 14 extends from the instrument body 12, e.g., the upper bout 16 can extend from the waist towards the neck 14. The lower bout 18 is the region from the waist towards the bottom of instrument body 12. The illustrative musical instrument 10 is implemented as a four string bass guitar, and thus includes four strings 20, 22, 24, and 26 that extend from a tailpiece 28 to a headstock 29 at the end of the neck 14.

In order to set an appropriate action to play the musical instrument 10, the strings 20, 22, 24, and 26 extend from the tailpiece 28 up and over a first string support that functions as a bridge 30. The bridge 30 is often positioned over the instrument body 12, typically arranged towards the lower bout 18 of the instrument body 12. The strings 20, 22, 24, and 26 apply downward pressure to the bridge 30, and thus define a first endpoint of the strings 20, 22, 24, and 26 for purposes of tuning and intonation. The strings 20, 22, 24, and 26 extend along the neck 14 above the fretboard, and seat over a second string support that functions as a nut 31. The nut 31 is located at the end of the neck distal from the instrument body 12, typically adjacent to the headstock 29. The strings 20, 22, 24, and 26 apply downward pressure to the nut 31, and thus define a second endpoint of the strings 20, 22, 24, and 26 for purposes of tuning and intonation. Finally, the strings 20, 22, 24, and 26 terminate past the nut 31, typically by extending at a slight downward angle to a corresponding set of tuning keys arranged on the headstock 29.

Figure 2A:
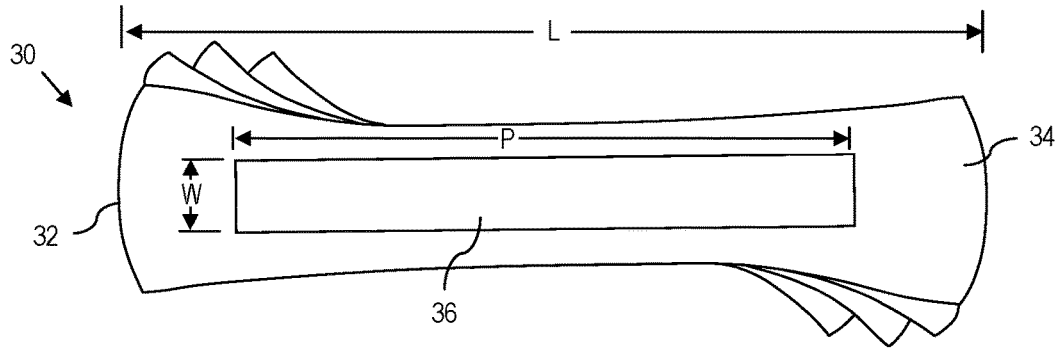
FIG. 2A is a top view of a string support used as a bridge according to aspects of the present disclosure, wherein plate sets are removed for clarity of illustration.
Figure 3A:
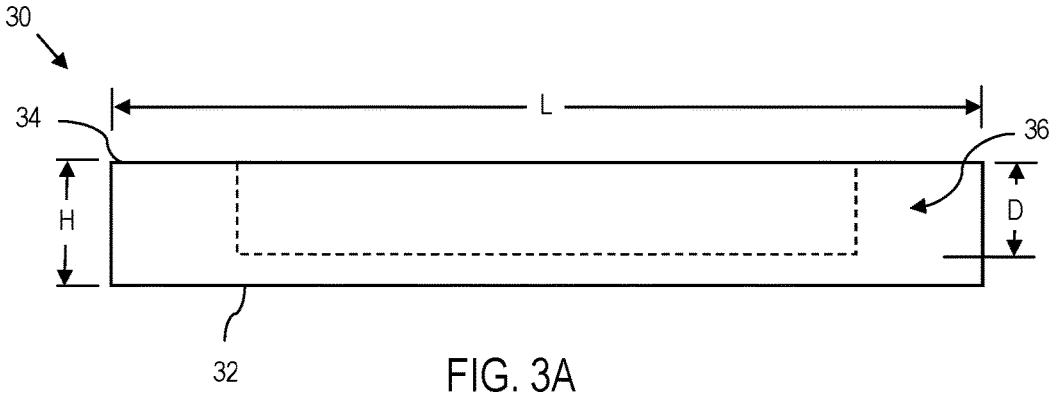
FIG. 3A is a side view of the bridge of FIG. 2A according to aspects of the present disclosure herein.

Referring to FIG. 2A and FIG. 3A, a string support implemented as a bridge 30 for a stringed musical instrument (e.g., the musical instrument 10 of FIG. 1) is illustrated in a top view (FIG. 2A), and a side view (FIG. 3A). The bridge 30 includes a support body 32 having a top surface 34 that extends along a major length (L). The support body 32 also includes a cavity 36 that recesses into the top surface 34 of the support body 32. For instance, in an example implementation, the support body 32 is wood. Here, the cavity 36 can be routed into the top surface 34. In other applications, the support body 32 can be constructed from or include other materials, for example, Corian, wood, carbon fiber, brass, a chrome-plated material (such as brass, steel, etc.), aluminum, nickel plated aluminum, zinc alloy, pot metal, tool steel, titanium, or other metal, plastic, TUSQ, bone, combinations thereof, etc. In this regard, the cavity 36 can be milled, machined, molded, etc. In other example applications, the support body 32 can be 3-D printed.

With reference to FIG. 2A, the cavity 36 is defined by a width W and a length that extends in a primary direction (P). Notably, the primary direction (P) of the cavity 36 need not coincide with (e.g., need not run parallel to the major length (L)) of the support body 32. This allows the primary direction of the cavity 36 to be at an angle slanted relative to the major length of the bridge body to provide string length compensation.

With reference to FIG. 3A, the cavity 36 is further defined by and a depth D. In the example implementation, the depth (D) extends partially, but not entirely, through the support body 32 as defined by a height (H) of the support body 32. In this regard, in practical implementations, the cavity 36 does not go all of the way though the support body 32. Rather, the cavity 36 recesses partially into the support body 32.

Figure 2B:
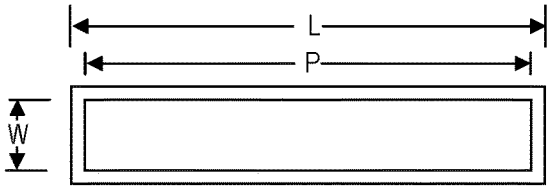
FIG. 2B is a top view of a string support used as a nut according to aspects of the present disclosure, wherein plate sets are removed for clarity of illustration.
Figure 3B:
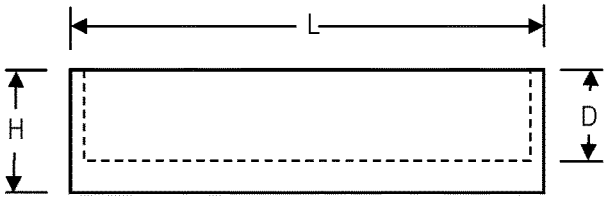
FIG. 3B is a side view of the nut of FIG. 2B according to aspects of the present disclosure herein.

Referring to FIG. 2B and FIG. 3B, a string support implemented as a nut 31 for a stringed musical instrument (e.g., the musical instrument 10 of FIG. 1) is illustrated in a top view (FIG. 2B), and a side view (FIG. 3B). Note that the nut 31 is implemented in an analogous manner to the bridge 30, and as such, like elements are indicated with like reference numerals. Here, one main difference between the bridge 30 and the nut 31 is the form factor (i.e., size and shape) of the support body 32. For the nut 31, the support body 32 is likely to be dimensionally constrained to have an overall length L that matches the width of the corresponding neck 14 (FIG. 1). Correspondingly, the support body 32 for the bridge 30 does not have to be constrained by the neck width. Moreover, it is possible to make a first string support, e.g., a bridge, support wider string spacing compared to a second string support, e.g., a nut, to accommodate player preference.

With reference to FIGS. 4A-4D, assemblies are provided. In some embodiments, the assemblies define at least one saddle where a corresponding string support functions as a bridge 30. In other embodiments, the assemblies define at least one nut slot where a corresponding string support functions as a nut 31. As illustrated, each assembly is defined by a plate set.

Figure 4A:
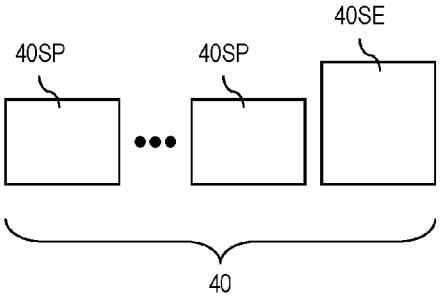
FIG. 4A is a first example plate set for use with the bridge of FIG. 2, according to aspects of the present disclosure herein.

With reference to FIG. 4A, a first plate set 40 comprises a string-engaging plate 40SE (SE represents "string-engaging") and at least one spacer plate 40SP (SP represents "spacer").

Figure 4B:
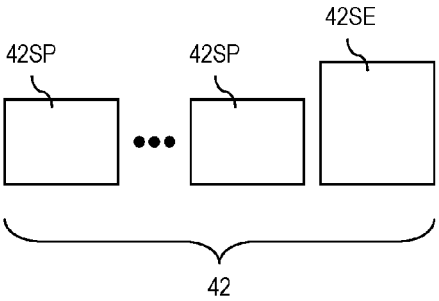
FIG. 4B is a second example plate set for use with the bridge of FIG. 2, according to aspects of the present disclosure herein.

With reference to FIG. 4B, a second plate set 42 comprises a string-engaging plate 42SE and at least one spacer plate 42SP. Here, the string-engaging plate 42SE can be the same height or a different height compared to the string-engaging plate 40SE of FIG. 4A, e.g., to account for a corresponding fretboard radius of a stringed musical instrument to which a corresponding string support is attached. The plates of the second plate set 42 can also have the same length and/or width or different length and/or with compared to the plates of the first plate set 40, e.g., to accommodate desired string spacing, intonation adjustability, etc.

Figure 4C:
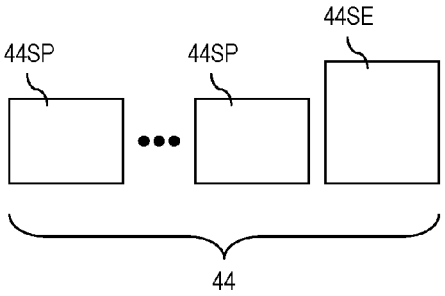
FIG. 4C is a third example plate set for use with the bridge of FIG. 2, according to aspects of the present disclosure herein.

Analogously, with reference to FIG. 4C, a third plate set 44 comprises a string-engaging plate 44SE and at least one spacer plate 44SP. Here, the string-engaging plate 44SE can be the same height or a different height compared to the string-engaging plate 40SE of FIG. 4A and the string-engaging plate 42SE of FIG. 4B. Also, the plates of the third plate set 44 can have the same length and/or width or different length and/or width compared to the plates of the other plate sets, e.g., to accommodate desired string spacing, intonation adjustability, etc.

Figure 4D:
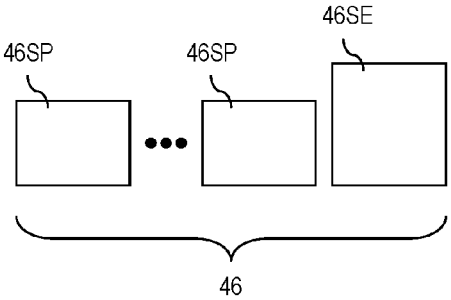
FIG. 4D is a fourth example plate set for use with the bridge of FIG. 2, according to aspects of the present disclosure herein.

Still further, with reference to FIG. 4D, a fourth plate set 46 comprises a string-engaging plate 46SE and at least one spacer plate 46SP. Here, the string-engaging plate 46SE can be the same height or a different height compared to the string-engaging plate 40SE of FIG. 4A, the string-engaging plate 42SE of FIG. 4B, and the string-engaging plate 44SE of FIG. 4C. Also, the plates of the fourth plate set 46 can have the same length and/or width or different length and/or width compared to the plates of the other plate sets, e.g., to accommodate desired string spacing, intonation adjustability, etc.

As noted in greater detail herein, in practice, there can be a single plate set or multiple plate sets, e.g., one plate set for all strings, one plate set for each pair of adjacent strings, etc. In an example implementation, there is one plate set per string of a corresponding stringed musical instrument. This allows adjustments to be made on a per string basis, independent of adjustments to other strings.

Figure 5A:
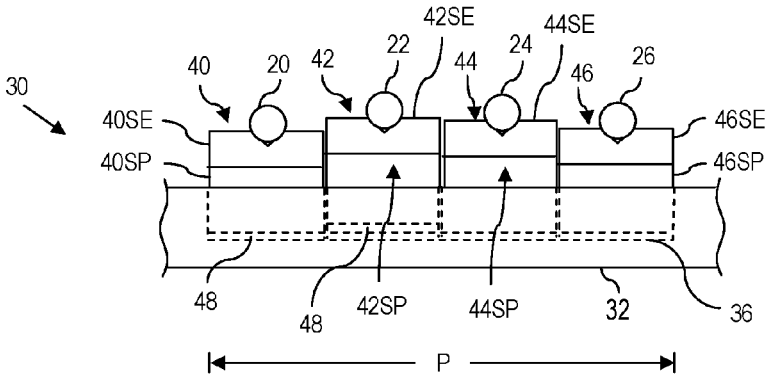
FIG. 5A is a schematic view of a string support, e.g., of FIG. 2A or 2B, illustrating plate sets installed therein, each plate set having a string-engaging plate having a string notch and a string resting thereupon according to aspects of the present disclosure.

With reference to FIG. 5A, the plate sets 40, 42, 44, 46 of FIGS. 4A-4B respectively, can be utilized in a string support (e.g., functioning as a bridge 30 or nut 31) suitable for a four stringed instrument, e.g., a bass guitar. In an example where the string support is a bridge 30 for a four string bass, there are four saddles, and thus four corresponding plate sets 40, 42, 44, 46. Analogously, in an example where the string support is a nut 31 for a four string bass, there are four nut slots, and thus four corresponding plate sets 40, 42, 44, 46.

In the case of a five string bass, the string support would include a fifth plate set (not shown) comprising a string-engaging plate and at least one spacer plate, a six string bass or guitar could include a sixth plate set (not shown) comprising a string-engaging plate and at least one spacer plate, etc.

In the illustrated embodiment, each string-engaging plate 40SE, 42SE, 44SE, and 46SE has a string-engaging portion extending above a top surface of the support body 32 by a height greater than a height of each spacer plate 40SP, 42SP, 44SP, and 46SP respectively. This allows the corresponding string to contact the string-engaging plate of each plate set 40, 42, 44, 46 (but not contact the associated spacer plates).

As illustrated, a string 20 rests on a string-engaging edge of the string-engaging plate 40SE. Likewise, string 22 rests on a string-engaging edge of the string-engaging plate 42SE, string 24 rests on a string-engaging edge of the string-engaging plate 44SE, and string 26 rests on a string-engaging edge of the string-engaging plate 46SE. In example implementations, each string may rest in a slot cut into the top of the associated string-engaging plate. In this regard, by selecting a string-engaging plate of a desired height, a first individual, per-string adjustment can be made. That is, each string can be set to a desired height by selecting an appropriate string-engaging plate having the desired height. For instance, as illustrated, the string-engaging plate 44SE is taller than the string-engaging plate 46SE. In practical implementations, string-engaging plates can be provided with different heights so that a user can select the string-engaging plate suitable for a given application. For instance, it may be desirable to set the height of each string 20, 22, 24, 26 to follow a radius of a corresponding fretboard. Of course, other factors can affect a string height desired by a user.

In addition to controlling action/string height via user-selection of a height of each string-engaging plate 40SE, 42SE, 44SE, 46SE, the width or spacing between each string can be set by a user-selected placement of a notch in each string-engaging plate 40SE, 42SE, 44SE, 46SE. For instance, using a file, knife, or other tool(s), a string slot can be used to form a resting place for each string. By setting the slot position along the end and/or edge of each string-engaging plate 40SE, 42SE, 44SE, 46SE, the string, when tensioned on the stringed musical instrument, will rest in the notch to position the corresponding string. As another example, string spacing can be controlled by selecting the length of each plate of one or more plate sets.

FIG. 5A clarifies that the first plate set 40 comprises a string-engaging plate 40SE and at least one spacer plate 40SP, where each plate 40SE, 40SP in the first plate set 40 seats vertically within the cavity 36, stacked in a direction of the width of the cavity. For instance, as illustrated, at least one spacer plate 40SP is illustrated as being in front of the string-engaging plate 40SE. Moreover, a face of at least one plate 40SE, 40SP in the first plate set 40 is substantially parallel to the primary direction of the cavity. Still further, as discussed above, the string-engaging plate 40SE has a string-engaging edge extending from a top surface of the bridge body at a height greater than a height of each spacer plate.

Also, as illustrated in FIG. 5A, the second plate set 42 comprises a string-engaging plate 42SE and at least one spacer plate 42SP, where the second plate set 42 is seated in the cavity 36 adjacent to the first plate set 40 in the primary direction. Likewise, the third plate set 44 comprises a string-engaging plate 44 SE and at least one spacer plate 44SP, where the third plate set 44 is seated in the cavity adjacent to the second plate set 42 in the primary direction. Yet further, the fourth plate set 46 comprises a string-engaging plate 46SE and at least one spacer plate 46SP, where the fourth plate set 46 is seated in the cavity 36 adjacent to the third plate set 44 in the primary direction.

In the application of a six string bass or guitar, the above concept can be expanded such that a fifth plate set comprising a string-engaging plate and at least one spacer plate can be provided, where the fifth plate set is seated in the cavity adjacent to the fourth plate set in the primary direction. Likewise, a sixth plate set comprising a string-engaging plate and at least one spacer plate can be provided, where the sixth plate set is seated in the cavity adjacent to the fifth plate set in the primary direction. Of course, this can be extended to any number of strings. Moreover, two or more strings may share a single string-engaging plate. Here, the tradeoff is reduced number of components in exchange for decreased per string flexibility.

As noted above, the height of each string need not be the same. In this regard, the string height can be set by selecting a string-engaging plate to have the appropriate height. In an example configuration, a kit is provided that includes string height options for the string-engaging plate(s) so that an ideal height can be obtained. In general, enough variation can be provided to allow the heights of the saddles to follow the fretboard radius. As yet an alternative configuration, one or more shims 48 can be used to make adjustments to string height. In practice, any combination of shims 48 (which may be seated under one or more plate sets) can be used alone or in combination with string-engaging plates of the same or different sizes.

Figure 5B:
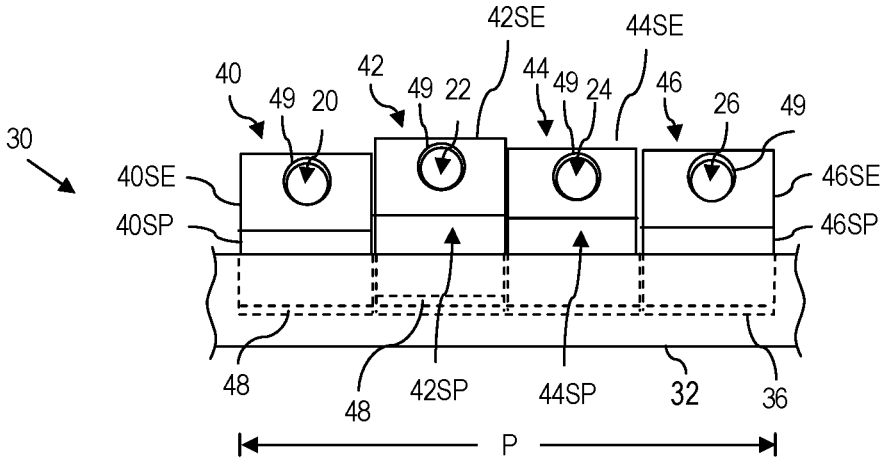
FIG. 5B is a schematic view of a string support, e.g., of FIG. 2A or 2B, illustrating plate sets installed therein, each plate set having a string-engaging plate having a string passthrough and a string fed through the string passthrough according to aspects of the present disclosure.

Referring to FIG. 5B, a string support (e.g., functioning as a bridge 30 or nut 31) is analogous to that described with regard to FIG. 5A, except that each string passes through a passthrough hole 49 in each string-engaging plate 40SE 42SE, 44SE, 46SE respectively (as opposed to resting in a notch on the top edge of the string-engaging plate 40SE 42SE, 44SE, 46SE as shown in FIG. 5A). Here, the passthrough hole is sized such that a corresponding string can pass through. Thus, the type of instrument, and hence the thickness of a corresponding string, will determine the size of the passthrough. Moreover, the passthrough hole can be implemented to include an edge that the string rests on, which can be positioned anywhere along the passthrough.

For instance, by drilling passthrough holes at an upward angle (away from the body angling from the lower bout upward toward the upper bout), a corresponding string will break across an edge of the passthrough hole about the surface of the string-engaging plate facing the neck, thus making intonation adjustments more consistent. Here, the passthrough can be set to a height greater than a height of each associated spacer plate.

Figure 6:
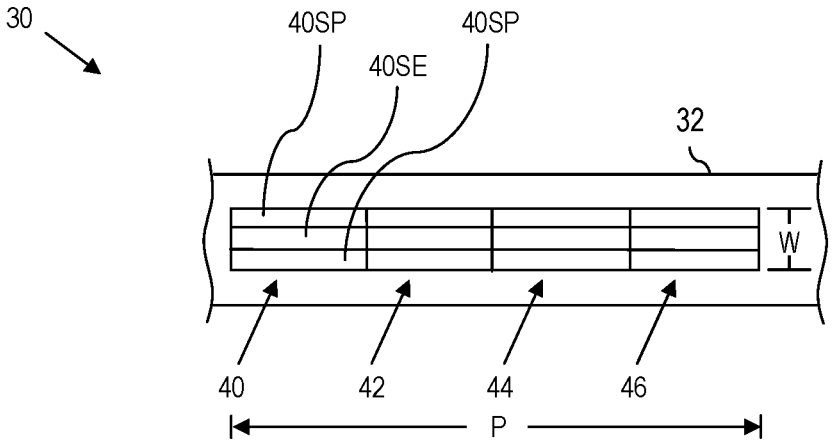
FIG. 6 is a top view of the string support of FIG. 2 showing the plate sets installed in the cavity of the bridge body.

Referring to FIG. 6, a top view of a string support, e.g., the bridge 30, the nut 31, both, etc., illustrates the arrangement of spacer plates and string-engaging plates. In the example as illustrated, the string-engaging plate 40SE is sandwiched between a pair of spacer plates 40SP. In practical applications, the order of the plates in the first plate set 40 is adjustable to position the string-engaging plate 40 SE forward or backward in the direction of the width W of the cavity, and hence, the length of the corresponding string. That is, since the plates are separate members, the order of the plates in the first plate set 40 is adjustable to position the string-engaging plate 40 SE forward or backward in the direction of the width (w) of the cavity 36 relative to one or more spacer plates 40 SP.

In practice, two or more spacer plates 40 SP will likely be used. As will be described more fully herein, the number of spacer plates and the thickness of each spacer plate defines the resolution of intonation adjustment available to the bridge. The thinner and/or more number of spacer plates, the finer the resolution of intonation adjustment.

Moreover, FIG. 6 shows that each plate in the first plate set 40 seats vertically within the cavity 36, stacked in a direction of the width (W) of the cavity 36. A face of at least one plate in the first plate set 40 is substantially parallel to the primary direction (P) of the cavity 36. A similar approach to arranging the spacer plates relative to the string-engaging plate can be applied to plate set 42, 44, 46, etc.

In an example configuration, the number of plates and the thickness of each plate are selected so that the plates, when stacked face to face, are substantially the width (W) of the cavity 36. In this regard, friction may be sufficient to keep the plates in a given plate set wedged into the cavity 36. A user can pull the plates to re-arrange the position of the string-engaging plate relative to the associated spacer plates.

Figure 7:
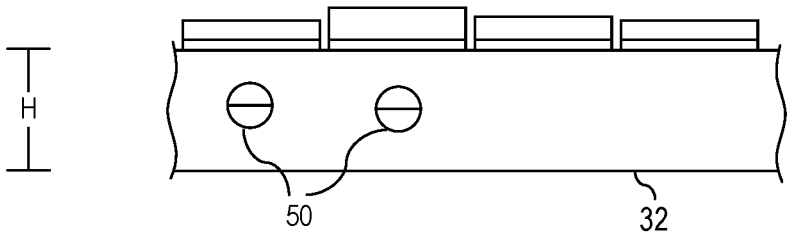
FIG. 7 is a back side view of the bridge of FIG. 2.
Figure 8:
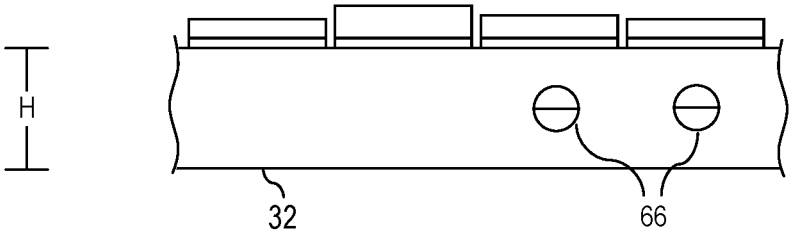
FIG. 8 is a front side view of the bridge of FIG. 2.

Referring to FIG. 7 and FIG. 8, in some cases, it may be desirable to include a securement device that extends into the support body 32 to secure a corresponding plate set. FIG. 7 shows securement devices implemented as set screws 50 that extend into the side of the support body 32 from the back edge, and FIG. 8 shows securement devices implemented as set screws 60 that extend into the side of the support body 32 from the front edge. The set screws apply pressure on the face of at least one plate, thus frictionally binding the corresponding plate set in the cavity 36. In practical implementations, each set screw may be on the same surface. They are shown on opposite sides for sake of thorough disclosure. Other approaches can be utilized to secure the plate sets to the support body 32, e.g., by friction, mechanical connections, etc.

Figure 9:
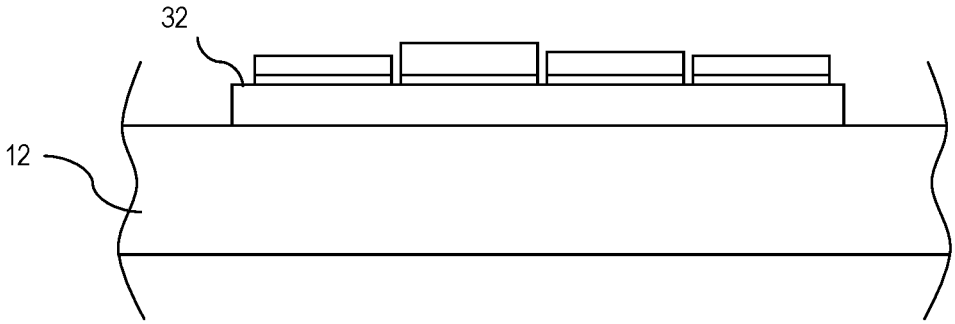
FIG. 9 is a partial side view of the bridge of FIG. 2 resting on an instrument body of a stringed musical instrument.

Referring to FIG. 9, the support body 32 may sit flush on the top surface of the instrument body 12. This implementation may be desirable for a string support implemented as the nut 31 (FIG. 1). This approach may also be useful for a string support implemented as a bridge 30 (FIG. 1) where the neck 14 extends substantially straight relative to the body 12.

Figure 10:
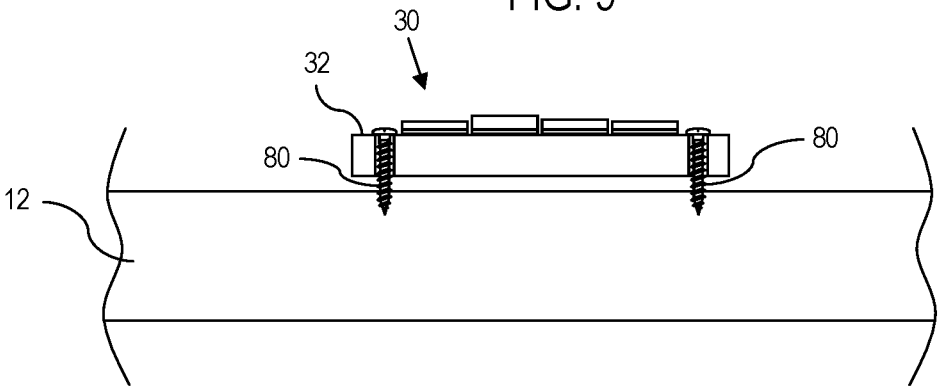
FIG. 10 is partial side view of an alternative embodiment compared to the view of FIG. 9, where the bridge includes a height adjustment mechanism that allows the height of the bridge to be adjusted relative to a top surface of a musical instrument.

Referring to FIG. 10, the support body 32 can also be height adjustable, so that the entire string support is adjustable. This is useful particularly for a string support implemented as a bridge 30 to set the bridge height relative to the instrument body 12. For instance, at least one height adjustment device is provided that raises and lowers the height of the support body 32 relative to a top surface of an instrument body 12 of a stringed musical instrument to which the bridge 30 is attached. For instance, the height adjustment device(s) can be implemented as a first height adjustment screw 80 through a first end portion of the support body 32 and a second height adjustment screw 80 through a second end portion of the support body 32 opposite the first adjustment screw. Here, the first and second adjustment screws 80 can be adjusted to independently raise and lower the height of the associated end of the support body 32 relative to a top surface of the stringed musical instrument body 12 to which the bridge 30 is attached. In alternative implementations, the height adjustment device(s) can be implemented as bolts, inserts, posts, etc.

In general, the sets of plates can be stainless steel, brass, TUSQ, graphite, wood, carbon fiber, bone, plastic, or any other suitable material, or any combination of materials. Moreover, the plates need not be the same material. For instance, the spacer plates may be stainless and the string-engaging plate may be brass. As another example, a string-engaging plate may be brass for one string, and stainless steel for another string, in the same bridge assembly.

In practice, at least three primary adjustments can be made. String spacing (distance between adjacent strings), can be set by filing a slot into each string-engaging plate so that a string sits in the slot of the corresponding string-engaging plate (best seen as the slight V-shaped notch that each string sits into in FIG. 5A). String spacing can also be set by setting the passthrough holes through each string-engaging plate (FIG. 5B). Also, string spacing is effected by the length of each string-engaging plate. Here, the string-engaging plates can have different widths, heights, thicknesses, etc., to achieve a desired result.

String height is set in a number of ways. For instance, string height can be set on string-by-string (or entire set of string) basis by using a shim 48. Moreover, string height can be adjusted by selecting the proper height of the associated string-engaging plate (e.g., 40SE, 42SE, 44SE, 46SE). Still further, the support body 32 itself may include height adjustment capability, e.g., via height adjusting members 80 or analogous components. Still further, string height can be adjusted using any combination of the above.

Intonation can be set by setting the order of the string-engaging plate relative to the associated spacer plates of a corresponding plate set, thus moving the string-engaging plate forward or backward in the lengthwise direction of the associated string. Moreover, as will be described below, intonation can be adjusted by shifting the entire string support (e.g., bridge) forward or backward relative to the neck, by using slots on the string support body that cooperate with posts, bolts, screws or other fasteners to movably secure the bridge to the instrument body 12.

Figure 11:
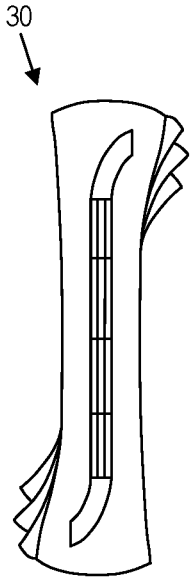
FIG. 11 is a top view of a bridge as described more fully herein.

Referring to FIG. 11, an example bridge 30 is illustrated as set out and described more fully herein.

Figure 12:
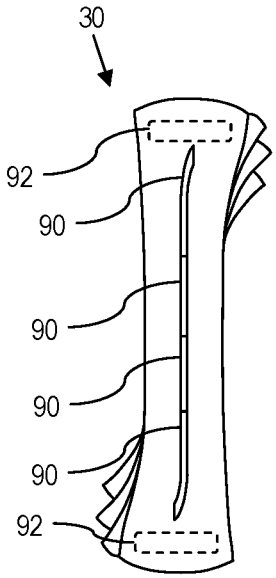
FIG. 12 is a top view of an alternative bridge as described more fully herein.

Referring to FIG. 12, an example bridge includes a curved wire. The bridge of FIG. 12 is largely analogous to the bridge 30 described in the preceding FIGURES, and thus can include all of the features described more fully herein. Except, instead of saddles comprised of a set of plates, the saddles are implemented by a one or more members 90. For instance, the members 90 can be implemented using fretwire, wire, a flexible plate, etc., that is extended across the bridge 30 to set a fixed saddle relative to the bridge 30. However, in this example, the entire bridge 30 (or a single end thereof) is shifted forward and backward along the direction of the length of a corresponding string, i.e., relative to the body of the musical instrument to set intonation. For instance, slots 92 underneath the bridge 30 engage corresponding posts (not shown) to allow a range of movement of the bridge 30 relative to the instrument body. Alternatively, the bridge 30 may "float", i.e., the bridge 30 may be held to the instrument body by the pressure of the strings. The bridge stays in place by string pressure and can be moved along the string path to allow for full intonation. In this regard, the slots 92 and/or floating bridge construction can also be applied to any of the embodiments or configurations illustrated in any of the preceding FIGURES.

Figure 13:
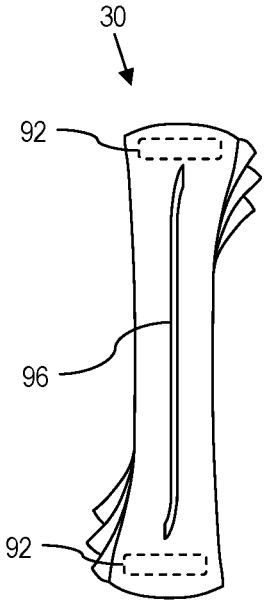
FIG. 13 is a top view of yet another alternative bridge as described more fully herein.

Referring to FIG. 13, another example bridge 30 also includes a curved wire. The bridge of FIG. 13 is largely analogous to the bridge 30 described in the preceding FIGURES, and thus can include all of the features described more fully herein. Except, instead of saddles comprised of a set of plates or separate members 90, the saddles are implemented by a continuous single member 96. For instance, fretwire, wire, a flexible plate, etc., is extended across the bridge to set a fixed saddle relative to the bridge. However, in this example, the entire bridge is shifted relative to the body of the musical instrument to set intonation. For instance, as with the embodiment of FIG. 12, slots and corresponding posts underneath the bridge (not shown) allow a range of movement of the bridge relative to the instrument body. Alternatively, the bridge may "float" held to the instrument body by the pressure of the strings.

Figure 14:
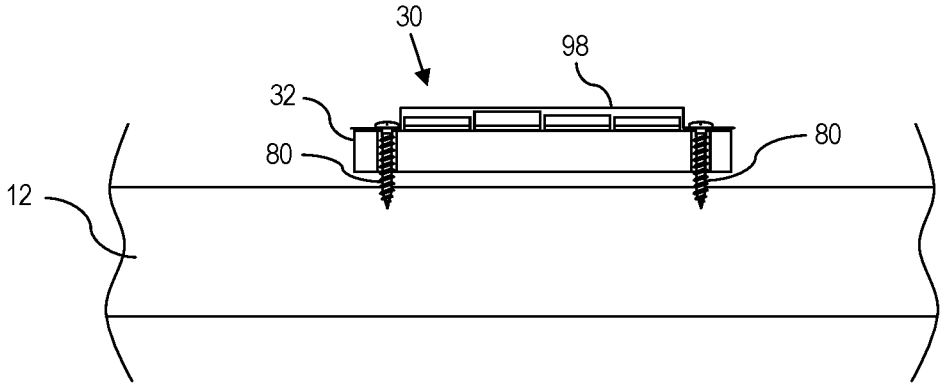
FIG. 14 is a view of a string support having a cover as described more fully herein.

Referring to FIG. 14, the string support can also include a cover 98 to overlie the plate sets. This may be desirable to provide various aesthetics, as a particular application dictates.

In this regard, a method of adjusting a setup of a stringed musical instrument comprises exposing a bridge on a musical instrument having an instrument body and neck that extends from the instrument body (e.g., by installing the bridge, removing old strings, etc.). Here, the bridge comprises a bridge body having a major length, a height, a top surface, and a cavity that recesses into the top surface of the bridge body, e.g., as described in greater detail herein. The cavity extends in a primary direction, having a width and a depth. The method also comprises arranging a plurality of plates into at least one plate set, e.g., one plate set for each string of the musical instrument, wherein each plate set comprises a string-engaging plate and at least one spacer plate. The method also comprises stacking the plates of each plate set so that the string-engaging plate is in a desired order relative to at least one spacer plate. The desired position achieves suitable intonation when the musical instrument is strung up using suitable strings.

Still further, the method comprises setting the plates in the cavity such that each plate set seats vertically within the cavity, stacked in the direction of the width of the cavity such that a face of at least one plate in each plate set is substantially parallel to the primary direction of the cavity. Here, the string-engaging plate of each plate set can have a string-engaging edge extending above a top surface of the bridge body by a height greater than a height of each corresponding spacer plate, a passthrough, etc., as described more fully herein.

In further exemplary implementations, the method can comprise setting the order of the plates in each plate set to independently position the string-engaging plate of each plate set forward or backward in the direction of the width of the cavity in order to set the intonation of a corresponding string on the musical instrument. As another example, the method can comprise raising the string height of a string associated with a select one of the plate sets by raising the height of the string-engaging plate in the cavity. As an example, raising the height of the string-engaging plate can comprise swapping out the string-engaging plate for a taller string-engaging plate. As another example, raising the height of the string-engaging plate can comprise installing a shim in the cavity underneath the string-engaging plate.

As further exemplary implementations, the method can also further comprise lowering the string height of a string associated with a select one of the plate sets by swapping out the string-engaging plate for a shorter string-engaging plate.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Aspects of the disclosure were chosen and described in order to best explain the principles of the disclosure and the practical application, and to enable others of ordinary skill in the art to understand the disclosure for various embodiments with various modifications as are suited to the particular use contemplated.

What is claimed is:

1. A string support for a stringed musical instrument, comprising:

a string support body having:

a major length;

a height;

a top surface; and a cavity that recesses into the top surface of the string support body, the cavity extending in a primary direction and having a width and a depth; and a first plate set comprising a string-engaging plate and at least one spacer plate;

wherein:

each plate in the first plate set seats vertically within the cavity, stacked in a direction of the width of the cavity;

a face of at least one plate in the first plate set is substantially parallel to the primary direction of the cavity;

the string-engaging plate has a portion thereof extending above the top surface of the string support body by a height greater than a height of each spacer plate; and the order of the plates in the first plate set is adjustable to position the string-engaging plate forward or backward in the direction of the width of the cavity.

2. The string support of claim 1 further comprising at least three additional plate sets including at least:

a second plate set comprising a string-engaging plate and at least one spacer plate, wherein the second plate set is seated in the cavity adjacent to the first plate set in the primary direction;

a third plate set comprising a string-engaging plate and at least one spacer plate, wherein the third plate set is seated in the cavity adjacent to the second plate set in the primary direction; and a fourth plate set comprising a string-engaging plate and at least one spacer plate, wherein the fourth plate set is seated in the cavity adjacent to the third plate set in the primary direction.

3. The string support of claim 1 wherein:

the string support body has a form factor corresponding to a bridge that attaches to a body of the stringed musical instrument.

4. The string support of claim 1 wherein:

the string support body has a form factor corresponding to a nut that attaches proximate to a headstock of the stringed musical instrument.

5. The string support of claim 1, wherein the first plate set comprises at least two spacer plates.

6. The string support of claim 1, wherein the a string-engaging plate comprises a passthrough hole sized such that a corresponding string can pass through.

7. The string support of claim 1 further comprising a first height adjustment device proximate a first end portion of the string support body and a second height adjustment device proximate a second end portion of the string support body opposite the first height adjustment device, the first and second height adjustment devices independently operable to raise and lower the height of the string support body relative to a top surface of a stringed musical instrument to which the string support is attached.

8. The string support of claim 1 further comprising at least one shim that sits underneath at least the string-engaging plate to adjust an overall height of the string-engaging plate relative to the string support body.

9. The string support of claim 1, wherein the primary direction of the cavity is at an angle slanted relative to the major length of the string support body.

10. A stringed musical instrument having an instrument body and neck that extends from the instrument body, the stringed musical instrument comprising:

a first string support defining a bridge that is arranged towards a lower bout of the instrument body, the first string support comprising:

a string support body having:

a major length;

a height;

a top surface; and a cavity that recesses into the top surface of the string support body, the cavity extending in a primary direction and having a width and a depth;

a plurality of plate sets, including at least:

a first plate set comprising a string-engaging plate and at least one spacer plate;

a second plate set comprising a string-engaging plate and at least one spacer plate;

a third plate set comprising a string-engaging plate and at least one spacer plate; and a fourth plate set comprising a string-engaging plate and at least one spacer plate;

wherein:

each of the plurality of plate sets seats vertically within the cavity, stacked in the direction of the width of the cavity;

a face of at least one plate in each plate set is substantially parallel to the primary direction of the cavity;

the string-engaging plate of each plate set extends above a top surface of the string support body by a height greater than a height of each corresponding spacer plate;

a first string is supported by the string engaging plate of the first plate set;

a second string is supported by the string engaging plate of the second plate set;

a third string is supported by the string engaging plate of the third plate set;

a fourth string is supported by the string engaging plate of the fourth plate set; and the order of the plates in each plate set is adjustable to independently position the string-engaging plate of each plate set forward or backward in the direction of the width of the cavity.

11. The string support of claim 10, wherein each plate set comprises at least two spacer plates.

12. The string support of claim 10 further comprising:

a second string support defining a nut that is arranged proximate to a distal end of the neck of the stringed musical instrument, the second string support comprising:

a string support body having:

a major length;

a height;

a top surface; and a cavity that recesses into the top surface of the string support body, the cavity extending in a primary direction and having a width and a depth;

a plurality of plate sets, including at least:

a first plate set comprising a string-engaging plate and at least one spacer plate;

a second plate set comprising a string-engaging plate and at least one spacer plate;

a third plate set comprising a string-engaging plate and at least one spacer plate; and a fourth plate set comprising a string-engaging plate and at least one spacer plate;

wherein:

each of the plurality of plate sets seats vertically within the cavity, stacked in the direction of the width of the cavity.

13. The string support of claim 10 further comprising a first height adjustment screw through a first end portion of the string support body and a second height adjustment screw through a second end portion of the string support body opposite the first adjustment screw, the first and second adjustment screws to raise and lower the height of the string support body relative to a top surface of a stringed musical instrument to which the string support is attached.

14. The string support of claim 10, wherein the primary direction of the cavity is at an angle slanted relative to the major length of the string support body.

15. A method of adjusting a setup of a stringed musical instrument comprising:

exposing a string support on a musical instrument having an instrument body and neck that extends from the instrument body, the string support comprising a string support body having a major length, a height, a top surface, and a cavity that recesses into the top surface of the string support body, the cavity extending in a primary direction and having a width and a depth;

arranging a plurality of plates into at least one plate set, wherein each plate set comprises a string-engaging plate and at least one spacer plate;

stacking the plates of each plate set so that the string-engaging plate is in a desired order relative to the at least one spacer plate; and setting the plates in the cavity such that each plate set seats vertically within the cavity, stacked in the direction of the width of the cavity such that a face of at least one plate in each plate set is substantially parallel to the primary direction of the cavity and the string-engaging plate of each plate set has a string-engaging portion thereof extending above a top surface of the string support body by a height greater than a height of each corresponding spacer plate.

16. The method of claim 15 further comprising:

setting the order of the plates in each plate set to independently position the string-engaging plate of each plate set forward or backward in the direction of the width of the cavity in order to set the intonation of a corresponding string on the musical instrument.

17. The method of claim 15 further comprising raising the string height of a string associated with a select one of the plate sets by raising the height of the string-engaging plate in the cavity.

18. The method of claim 17, wherein raising the height of the string-engaging plate comprises swapping out the string-engaging plate for a taller string-engaging plate.

19. The method of claim 17, wherein raising the height of the string-engaging plate comprising installing a shim in the cavity underneath the string-engaging plate.

20. The method of claim 15 further comprising lowering the string height of a string associated with a select one of the plate sets by swapping out the string-engaging plate for a shorter string-engaging plate.

* * * * *